United States Patent [19]

Nakazawa et al.

[11] 4,383,653

[45] May 17, 1983

[54] TRAVERSE MOTION USED IN COMBINATION WITH DEVICE FOR WINDING A CONTINUOUS ELONGATE ELEMENT

[75] Inventors: Koji Nakazawa; Michio Sato; Shin Kasai; Yutaka Kawaguchi; Toshiaki Kikuchi, all of Fukushima, Japan

[73] Assignee: Nitto Boseki Co., Ltd., Fukushima, Japan

[21] Appl. No.: 193,412

[22] Filed: Oct. 3, 1980

[30] Foreign Application Priority Data

Oct. 8, 1979 [JP] Japan ..... 54-129640

[51] Int. Cl.[3] ..... B65H 54/28

[52] U.S. Cl. ..... 242/43 R; 242/18 R; 242/18 G; 242/158.3

[58] Field of Search ..... 242/43 R, 158.3, 18 G, 242/18 R

[56] References Cited

U.S. PATENT DOCUMENTS

| | | | |
|---|---|---|---|
| 2,345,601 | 4/1944 | Hickes | 242/43 R |
| 3,089,657 | 5/1963 | Chaussy | 242/43 R |
| 3,310,248 | 3/1967 | Have | 242/43 R |
| 3,352,505 | 11/1967 | Parker | 242/43 R |
| 3,547,361 | 12/1970 | Klink | 242/18 G |
| 3,695,523 | 10/1972 | Genson et al. | 242/18 R |
| 3,861,607 | 1/1975 | Schippers et al. | 242/43 R |
| 4,235,387 | 11/1980 | Nicoulaud et al. | 242/18 G |

FOREIGN PATENT DOCUMENTS

| | | | |
|---|---|---|---|
| 1054337 | 10/1953 | France | 242/43 R |
| 48-39527 | 8/1973 | Japan . | |
| 49-6495 | 2/1974 | Japan . | |

*Primary Examiner*—Stanley N. Gilreath

*Attorney, Agent, or Firm*—Norbert P. Holler; Charles A. Blank

[57] ABSTRACT

A traverse motion used in combination with a device for winding a continous elongate element such as a strand consisting of a large number of glass filaments drawn through a bushing with a large number of nozzles. In the traverse motion of the type including a scroll cam with an endless cam groove consisting of at least one pair of right- and left-hand grooves joined at each end and a strand guide which has a cam follower fitted in the endless cam groove of the scroll cam and is adapted to reciprocate along a straight path in parallel with the axis of the shaft of the scroll cam when the latter is rotated, the lead angle of the endless cam groove is increased adjacent to its ends or adjacent to each returning point of the cam follower so that the guide is increased in velocity adjacent to each returning point. With a conventional scroll cam the traversing motion of the strand at the downstream of the strand guide lags behind that of the strand guide in the case of winding the strand into package on a spool so that the ends of a package being formed are increased in diameter as compared with the intermediate portion between them. When the strand guide is increased in the manner described above adjacent to each returning point, the flange-like increased-diameter distortions at the ends of the package can be avoided and high-quality packages with square ends can be produced.

3 Claims, 10 Drawing Figures

TRAVERSE MOTION USED IN COMBINATION WITH DEVICE FOR WINDING A CONTINUOUS ELONGATE ELEMENT

BACKGROUND OF THE INVENTION

The present invention relates to generally a traverse motion used in combination with a device for winding a continuous elongate element around a spool and more particularly a traverse motion adapted to produce packages of large-diameter strands consisting of a large number of glass filaments.

In general, conventional bushings used for producing glass fibers have been provided with orifices from 400 to 800 in number and glass filaments drawn through such bushings have been from 10 to 13 microns in diameter. In order to form packages of roving with a desired diameter from such glass filaments, there has been required such a cumbersome process that glass filaments from 400 to 800 in number drawn from each bushing are gathered into a strand which in turn is wound around a spool to form a cake and thereafter strands are unwound from 15 to 30 cakes and gathered into a roving which in turn is wound around another spool to form a package.

However, recently there have been devised and demonstrated various multiple-nozzle spinning techniques of the type in which glass filaments from 2000 to 4000 in number and from 15 to more than 20 microns in diameter can be simultaneously spun from a single bushing so that packages can be directly formed by merely gathering these glass filaments into a strand which in turn is wound around a spool to form a package. Since packages can be formed by one step, productivity has been considerably improved, but with the conventional winding devices, it is impossible to produce packages with high qualities. Packages with high qualities mean (1) that every package is almost in the form of a correct cylinder which has the parallel bases or ends perpendicular to the axis of the package and whose peripheral surface is completely free from ridges and valleys; that is, every package has square ends; (2) that the whole length of strand of every package is uniform in diameter and is free from fuzz; and (3) that every package has a uniform hardness from the center to the peripheral surface.

It follows therefore that in order to obtain such packages with high qualities, one of the conditions which must be satisfied is that the strand winding tension must be maintained always constant so that the strand wound has a uniform diameter and the formed packages have a uniform hardness as described above. This condition is also important in order to stabilize the spinning operation of multiple-nozzle bushings which are very sensitively influenced by the variations in glass filament drawing tension. More over, since the strand applied with a lubricant is very slippery, the variations in winding tension tend to cause such strand to slip off from the ends of the package being formed so that the resultant package may get out of the shape having square ends. In addition, the strand wound into the package is flattened at various portions so that fuzz is produced. Thus the qualities of the packages are degraded. Furthermore when the strand is unwound, it bonds itself so that the smooth unwinding cannot be effected. In order to maintain a uniform winding tension, the strand winding speed must be maintained uniform. To this end, there have been employed a method in which the rotational speed of a spool is decreased in inverse proportion to the quadratic increase in diameter of the package being formed so that the peripheral or surface speed of the package can be maintained uniform.

In order to obtain high-quality packages with square ends, another problem must be taken into consideration. The problem is the delay in response of strand which is inevitable to transverse motions. More specifically, when the strand is wound around a spool, it is traversed by a traverse motion. In this case, the traversing movement of strand lags behind the reciprocating movement of a strand guide by some time. As a result, the traversing movement of strand is suspended or dwells for some time interval at each returning point so that the diameter at each end of a package becomes greater than that of the intermediate portion and consequently the finished package becomes in the form like a hand-drum. In general, the higher the traversing speed, the longer the relative delay in response of strand becomes. This dwelling problem becomes therefore very serious especially in the case of the production of packages for F.R.P. because these packages must have a large traverse angle (the angle between a wound strand and a plane perpendicular to the axis of the spool) and consequently a high traversing speed is needed. In order to overcome this problem, there has been devised and demonstrated a method in which a pressure roller is constantly pressed against the surface of a package being formed, thereby making the surface flat. However, obviously the more pronounced the hand-drum form becomes, the higher the pressing force becomes. As a result, turns of strand at the ends of a package being formed slip off, thus causing the ends of the package to collapse. In addition, since the pressure roller exerts higher pressure against the ends of a package being formed, turns of strand at the ends become flat. Especially in the case of the production of packages for F.R.P. which must satisfy a strict requirement on a uniform quality of strand, flattening of strand must be avoided. Furthermore, the increase in contact pressure of the pressure roller against a package being formed results in vibrations of the traverse motion so that the strand comes off from the strand guide and other malfunctions tend to occur.

In order to solve the problem of the package formed into the hand-drum form only by means of the traverse motion, there has been devised and demonstrated a method in which a scroll cam is provided with a $\frac{1}{4}(2n+1)$ wind cam groove, where n is any natural number, so that the strand guide returns its initial position after two reciprocating motions and two returning points of the cam groove at each end of the scroll cam are staggered so that there are two different returning points of the strand at each end of a package being formed. This method serves to suppress the formation of the enlarged-diameter ends of the package to some extent, but cannot eliminate them completely.

SUMMARY OF THE INVENTION

In view of the above, the primary object of the present invention is to provide a traverse motion for use in combination with a device for winding a continuous elongate element, which traverse motion can substantially suppress the formation of flange-like enlarged-diameter ends of package, whereby the production of high-quality package can be ensured.

To this end, briefly stated, the present invention provided a traverse motion used in combination with a device for winding a continuous elongate element, of the type having a scroll cam consisting of a rotatable cylindrical body and an endless cam groove consisting of at least one pair of right- and left-hand helical grooves cut in the peripheral surface of said cylindrical body and joined at both ends thereof, a cam follower fitted into said helical grooves of said scroll cam and guided to be reciprocable along a path in parallel with the axis of said scroll cam when the latter is rotated, and guide means connected to said cam follower for traversing said continuous elongate element, in which the lead angle of said helical grooves is increased over a predetermined distance adjacent to each end thereof, whereby said guide means can be increased in velocity over said predetermined distance.

The above and other objects, effects and features of the present invention will become more apparent from the following description in conjunction with the accompanying drawings of a preferred embodiment thereof used in combination with a device for winding large-diameter strands consisting of a large number of glass filaments.

DESCRIPTION OF THE PREFERRED EMBODIMENT

Figure 1:
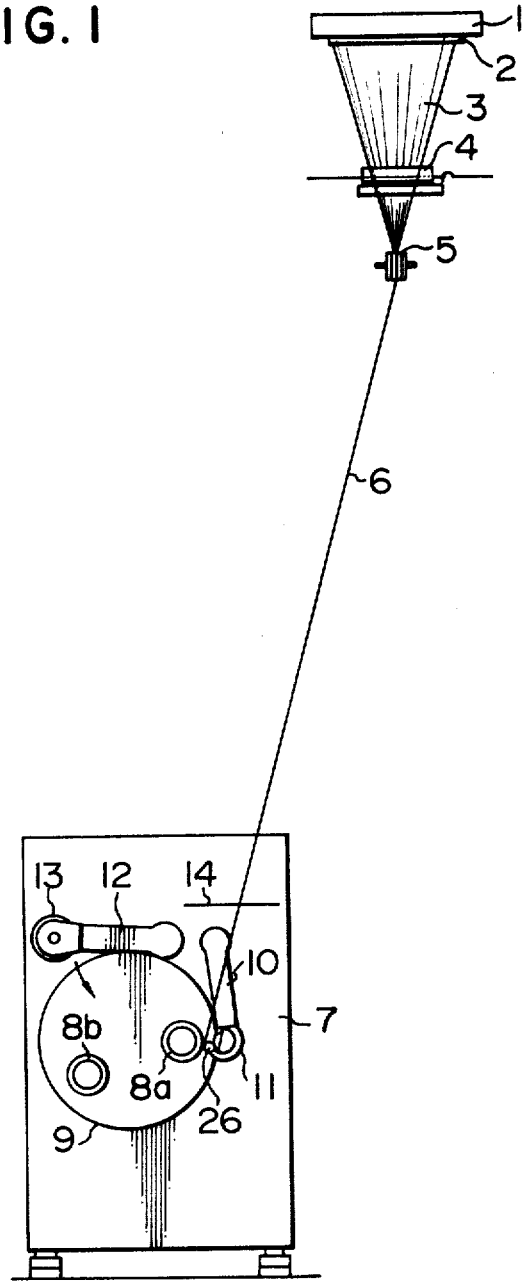
FIG. 1 is a schematic view showing that a large number of glass filaments drawn from a bushing are directly formed into a package by a continuous winding device in which is incorporated a traverse motion in accordance with the present invention.

FIG. 1 shows a device for continuously winding a continuous elongate element disclosed in Japanese Patent Laid-Open Publication No. 56-43164. The device is shown as winding glass fibers into a package. Molten glass is drawn through 2000 to 4000 nozzles 2 at the bottom of a bushing 1 into glass filaments 3. After having been applied with a lubricant by a roll sizer 4, they are gathered by a gathering roller 5 into a strand 6 which in turn is wound by the winding device.

The winding device has a main body 7 in which are mounted drive motors, hydraulic cylinders, transmission gears, control devices and so on as will be described in detail below. Mounted on the front panel of the main body 7 are a turret 9 which carries two horizontal winding spools 8*a* and 8*b*, a traverse motion 11 mounted on a swinging arm 10, an auxiliary winding spool 13 mounted rotatably on a swinging arm 12 and a strand guide rod 14 which is extended at right angles to the axes of the main and auxiliary spools 8*a*, 8*b* and 13 and the traverse motion 11 and is movable in the same directions as these axes. The strand 6 is shown as being wound around the main winding spool 8*a* while being traversed by the traverse motion 11.

When the main winding spool 8*a* becomes full, the arm 12 is swing in the direction indicated by the arrow so that the auxiliary winding spool 13 is made into abutment with the free end of the main winding spool 8*a*. Thereafter the strand guide rod 14 transfers the strand 6 to the auxiliary winding spool 13 so that the latter starts winding the strand 6. Thus the winding device can continue the winding of the strand by the auxiliary winding spool 13 while the full main spool is retracting from the operative or winding position and the other empty main spool is advancing to the winding position. As a result, the glass filaments 3 are always applied with uniform tensions so that the spinning operation with the multiple-nozzle bushing can be stabilized.

Figure 2:
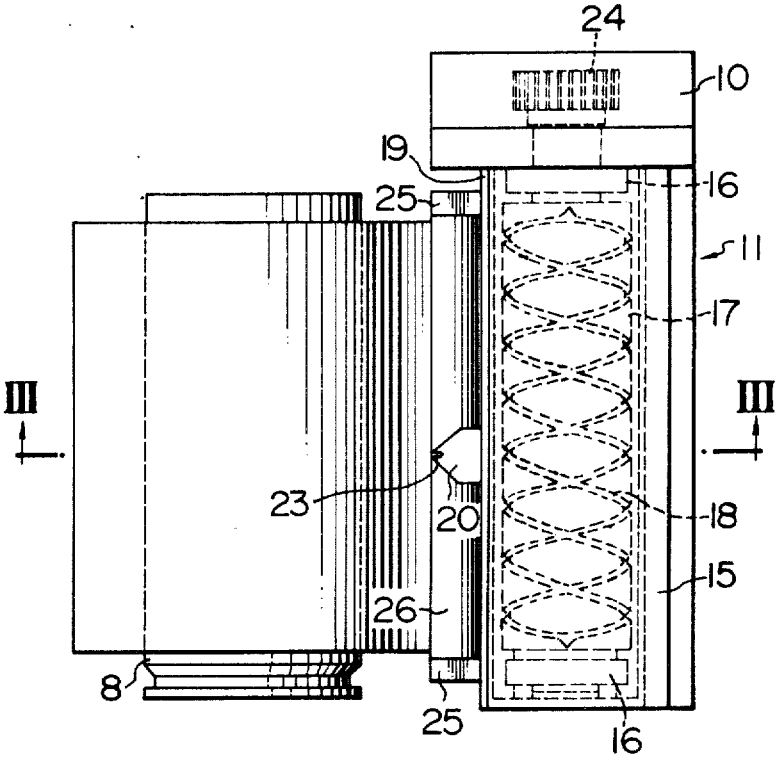
FIG. 2 is a top view of a preferred embodiment of a traverse motion in accordance with the present invention.
Figure 3:
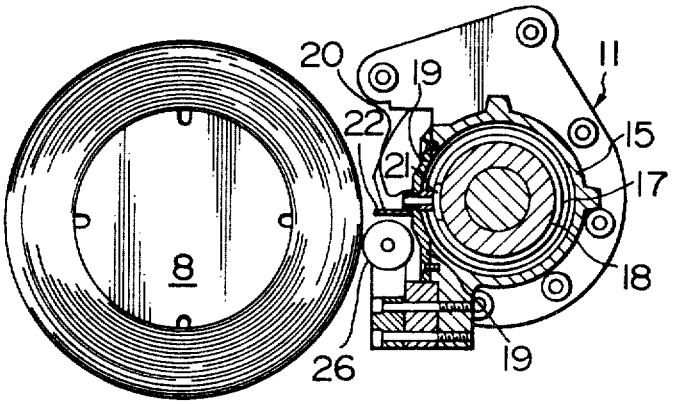
FIG. 3 is a sectional view taken along the line III—III of FIG. 2.

The traverse motion 11 is shown in detail in FIGS. 2 and 3. It includes a cylindrical scroll cam 17 with helical grooves 18 which is rotatably supported by spaced apart bearings 16 in a housing 15 which in turn is extended horizontally from the extreme end of the supporting arm 10 in parallel with the axis of the spool 8 as best shown in FIG. 2. The housing 15 has an axial opening or slot cut through the peripheral wall facing the spool 8 and extended over the whole length of the housing. Upper and lower rails 19 are securely attached along the upper and lower sides of the axial opening and a slider 20 is slidably guided by these rails 19.

Figure 4:
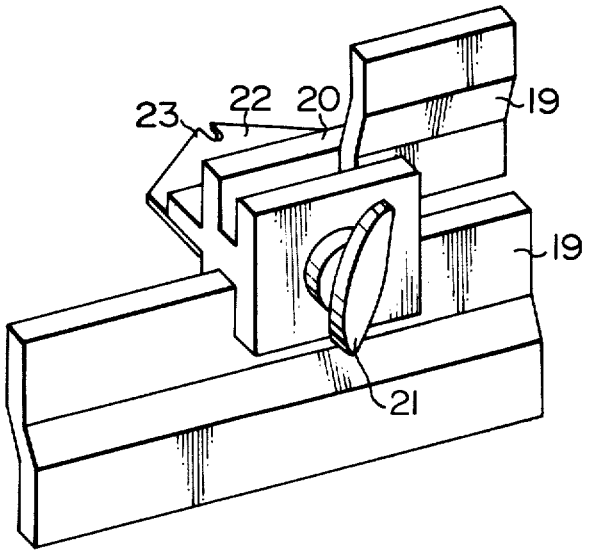
FIG. 4 is a perspective view of a strand guide of the traverse motion and its associated guide rails shown in FIGS. 2 and 3.

The construction of the slider 20 is shown in detail in FIG. 4. The slider has a cam follower 21 extended backwardly and slidably fitted into the helical grooves 18 of the scroll cam 17 and a strand guide 22 extended toward the main spool 8. The strand guide 22 is in the form of a equilateral triangle and has a notch 23 at the vertex.

Referring back to FIGS. 2 and 3, the end of the side of the supporting arm 10 of the scroll cam 17 carries a timing pulley 24 (See also FIG. 6) which in turn is drivingly coupled to a prime mover for rotating the scroll cam 17 as will be described in detail later. A pressure roller 26 which is extended in parallel with the scroll cam 17 is rotatably supported at its ends by axially spaced bearings 25 which in turn are mounted on brackets extended from the lower front portion of the housing 15.

The scroll cam 17 is so designed that, as is well known in the art, upon rotation of the cam 17 the cam follower 21 and hence the slider 20 is caused to reciprocate along the guide rails 19 between the ends of the scroll cam 17, whereby the strand passing through the notch 23 of the strand guide 22 is traversed while winding on the main spool 8.

Figure 5:
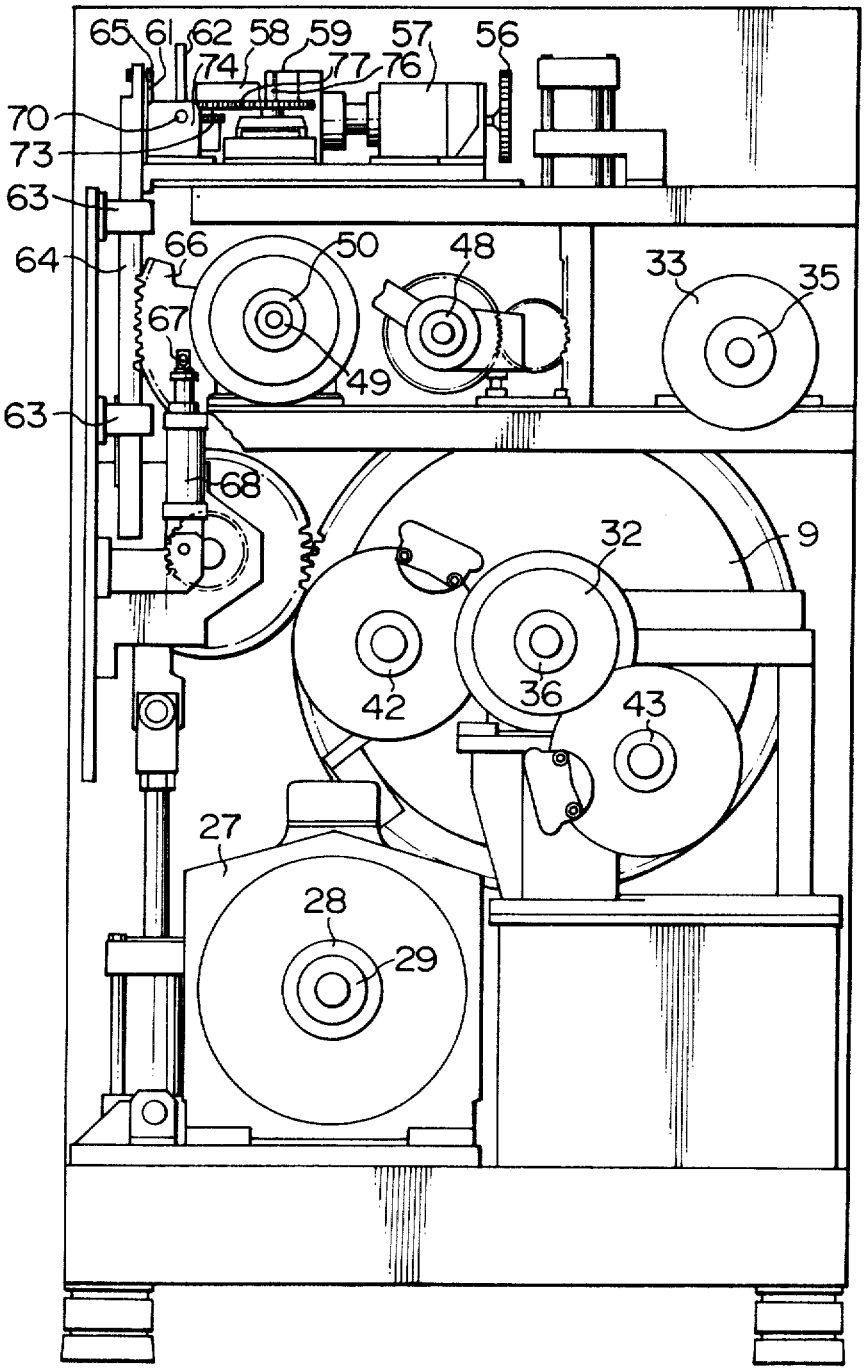
FIG. 5 is a rear view of the main body with a door removed of the continuous winding device shown in FIG. 1, showing the arrangement of parts inside the main body.
Figure 6:
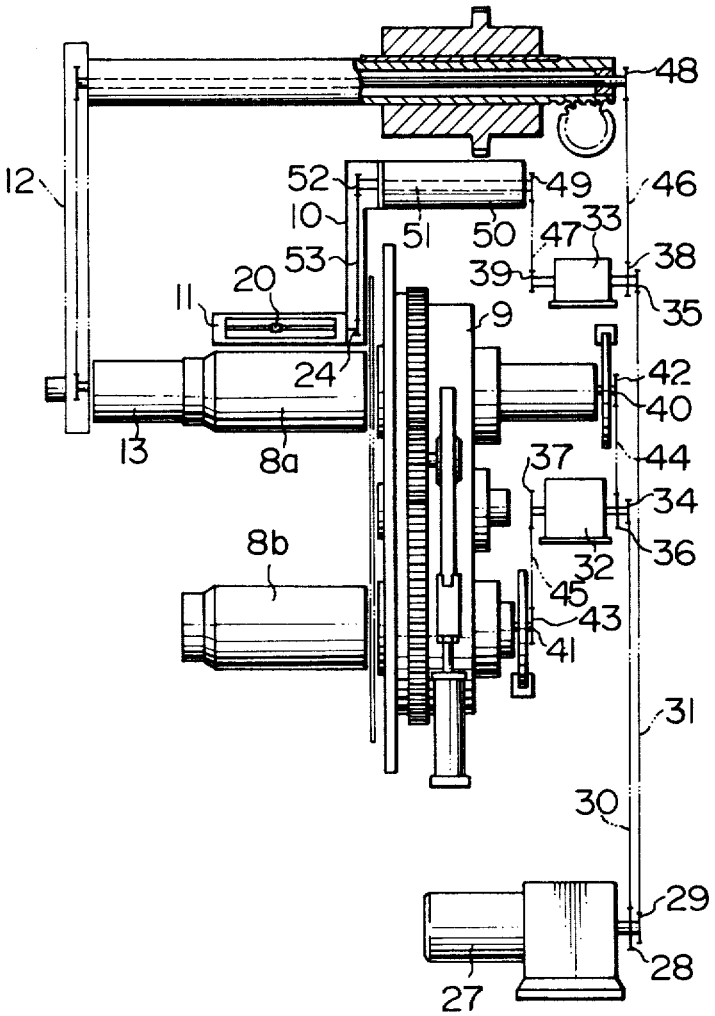
FIG. 6 is a side view thereof showing the arrangement of driving mechanisms.

Next referring to FIGS. 5 and 6, the mechanism for driving the spool 8 and the traverse motion 11 will be described in detail. FIG. 5 shows the interior of the main body 7 of the winding device looking at the rear side thereof while FIG. 6 is a side view thereof and is used mainly for the explanation of the arrangement of various parts of the driving mechanism. A variable-speed motor 27 is mounted on the bottom wall of the main body 7. Two timing pulleys 28 and 19 are attached to the drive shaft of the motor 27 and drivingly coupled with timing belts 30 and 31 to timing pulleys 34 and 35, respectively, attached to the input shafts of electromagnetic clutches 32 and 33. Both the clutches 32 and 33 are of the double clutch type and each has two output shafts carrying timing pulleys 36 and 37 or 38 and 39 which are driven independently or simultaneously. The timing pulleys 36 and 37 are drivingly coupled with timing belts 44 and 45, respectively, to timing pulleys 42 and 43 which in turn are carried by spindles 40 and 41, respectively, of the main spools 8*a* and 8*b* rotatably mounted on the turret 9. The timing pulleys 38 and 39 are drivingly coupled with timing belts 46 and 47, respectively, to timing pulleys 48 and 49 for driving the auxiliary spool 13 and the traverse motion 11, respectively.

The base of the traverse motion supporting arm 10, which is hollow, is securely joined to the front end (the left end in FIG. 6) of a hollow shaft 50 so that as the shaft 50 rotates the supporting arm 10 is caused to swing. A rotary shaft 51 is extended through the hollow shaft 50 and the timing pulley 49 is joined to the rear end (the right end in FIG. 6) of the rotary shaft 51 extended beyond the rear end of the hollow shaft 50. A timing pulley 52 is joined to the front end of the rotary shaft 51 and is drivingly coupled with a timing belt 53 to the timing pulley 24 which in turn is carried by the shaft of the scroll cam 17 (See also FIG. 2). Thus the scroll cam 17 of the traverse motion 11 is driven by the motor 27 when the clutch 33 is so actuated as to couple its input shaft to its output shaft carrying the timing pulley 39.

The traverse motion 11 is so designed and constructed that it can be retracted from the package on the main spool 8*a* or 8*b* with the increase in diameter of the package in such a way that a predetermined distance may be maintained between the traverse motion 11 and the surface of the package.

The mechanism for retracting the traverse motion in the manner described above is shown in detail in FIG. 7. A variable-speed motor 54 is coupled through intermeshing gears 55 and 56 to a reduction gear 57 which in turn is connected to an electromagnetic clutch 59 supported by a bearing 58. The output shaft 60 of the clutch 59 carries two plate cams 61 and 62. As shown also in FIG. 5, a cylindrical roller 65 which engages with the plate cam 61 is rotably mounted at the upper end of a rack 64 which in turn is slidably mounted on vertically spaced brackets 63. A sector gear 66 is mounted on the hollow shaft 50 and is made into mesh with the rack 64 so that as the rack 64 vertically moves, the supporting arm 10 is caused to swing about the axis of the hollow shaft 50. More specifically, while the package is being formed, the electromagnetic clutch 59 is energized so that the rotation of the motor 54 is transmitted through the reduction gear 57 to the plate cam 61 and consequently the rack 64 is raised. As a result the sector gear 66 is caused to rotate in the clockwise direction in FIG. 5 so that the traverse motion 11 is gradually retracted from the main spool 8*a* or 8*b*. The quaradic increase in diameter of the package can be calculated and the plate cam 61 can be so designed and constructed that the traverse motion 11 is gradually retracted away from the main spool 8*a* or 8*b* with the calculated increase in diameter of the package in such a way that a predetermined distance can be maintained between the radially outwardly expanding surface of the package and the strand guide 22 (See FIG. 4).

Still referring to FIG. 5, the piston rod of a hydraulic cylinder 68 is pivoted with a pin 67 to the sector gear 66. The hydraulic cylinder 68 is so actuated that when the package is being formed the piston rod is retracted and consequently the sector gear 66 is imparted with the torque in the counterclockwise direction. This torque acting on the sector gear 66 in the counterclockwise direction is lower than the torque acting thereon in the clockwise direction due to the upward movement of the rack 64, but the counterclockwise torque causes the pressure roller 26 of the traverse motion 11 to be pressed against the surface of the package being formed under a predetermined pressure while the traverse motion 11 is retracted in the manner described previously, whereby the uniform package surface can be attained. In addition, this counterclockwise torque also serves to prevent the vibrations of the traverse motion 11 itself and its pressure roller 26. After the package has been formed, the hydraulic cylinder 68 is so actuated as to extend its piston rod, thereby causing the sector gear 66 to further rotate in the clockwise direction whereby the pressure roller 26 and the traverse motion 11 are moved further away from the package.

Figure 7:
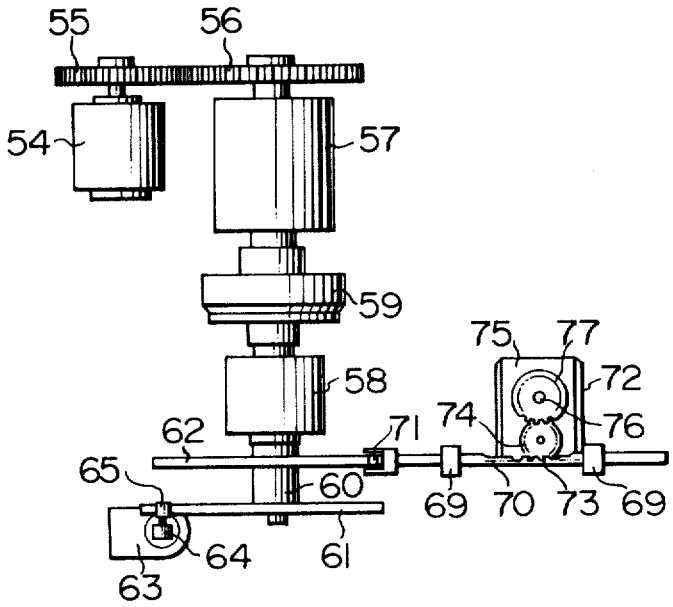
FIG. 7 is a top view of a mechanism for not only controlling the retraction of the traverse motion but also controlling the winding speed in response to the increase in diameter of a package being formed.

Referring to FIGS. 5 and 7, the plate cam 62 is used for controlling the motor 27 in such a way that a constant strand winding velocity can be maintained. Maintenance of a constant winding velocity is very important in order not only to ensure that the filaments drawn from the bushing have the same diameter and every package has same quality but also to ensure the stable spinning operation with the multiple-nozzle bushing. If the main spool 8*a* or 8*b* is rotating at a constant velocity, the winding velocity; that is, the peripheral velocity of the package being formed will increase with the increase in diameter of the package. It follows therefore that the rotational speed of the main spool 8*a* or 8*b* must be decreased in inverse proportion to the increase in diameter of the package being formed.

A roller 71 which is made into engagement with the periphery of the plate cam 62 is rotatably mounted at the left end (See FIG. 7) of a rack 70 which in turn is horizontally slidably supported by brackets 69 so that as the plate cam 62 rotates, the rack 70 is caused to shift to the right. The rack 70 is in mesh with a pinion 73 rotatably mounted on a bracket 72 and a gear 74, which is mounted coaxially of the pinion 73 for rotation in unison therewith, is in mesh with a gear 77 carried by the shaft 76 of a shift sensor 75 such as a potentiometer. The gear 77 is normally biased in the counterclockwise direction under the force of a bias spring (not shown) so that the rack 70 in turn is normally biased to the left and consequently the cam roller 71 is pressed against the periphery of the cam plate 62. The angle of rotation of the shaft 76 is converted into a voltage signal which in turn is transmitted to a control system (not shown) of the motor 27.

The reference points of the coaxial plate cams 61 and 62 are aligned so that the angle of rotation of the cam 62 corresponds to the increase in diameter of the package being formed. Therefore the cam plate 62 is so designed and constructed that the control signal generated in response to the angle of rotation of the shaft 76 of the sensor 75 controls the motor 27 in such a way that the rotational speed of the main spool is decreased with the increase in diameter of the package being formed so as to maintain the peripheral speed of the package constant.

It will be noted that during formation of a package the control system as described above operates in such a way that the main spool 8a and 8b is so rotating as to maintain a constant winding velocity, a predetermined distance can be maintained between the traverse motion 11 and the radially outwardly expanding surface of the package, and the pressure roller 26 is pressed against the surface of the package under a predetermined pressure, so that the winding conditions are maintained constant from the start to the end of the package formation. Thus it may be said that the fundamental conditions for obtaining packages with high qualities can be satisfied. However, in order to obtain the packages with higher qualities, the inherent problem of the prior art traverse motion; that is, the problem that the diameters at the ends of the package are greater than that between them so that the finished package becomes in the form like a hand-drum, must be overcomed.

Figure 8A:
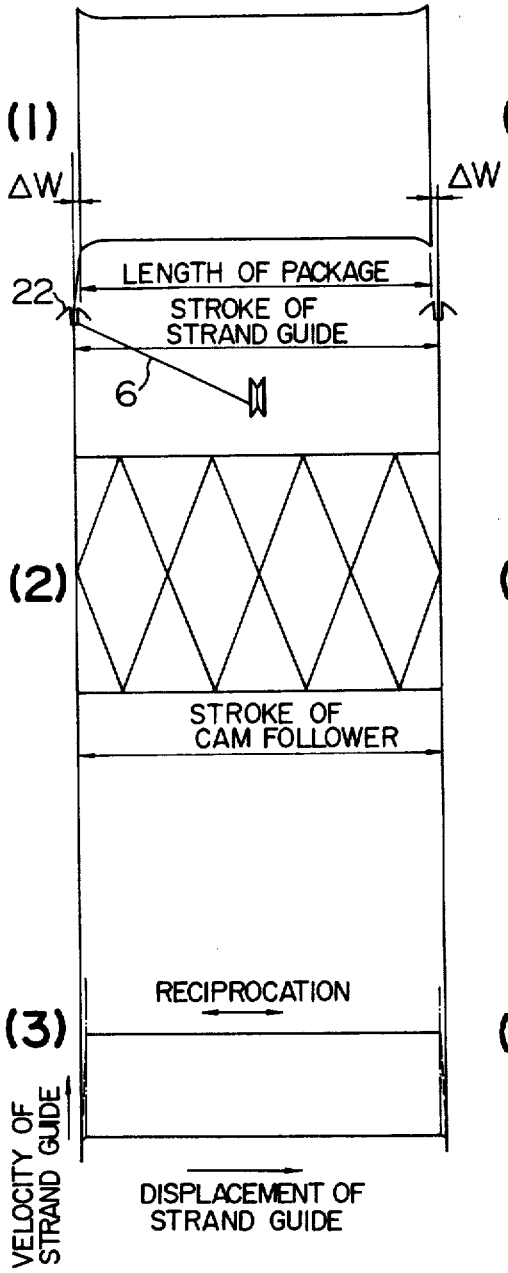
FIG. 8a PRIOR ART
FIG. 8*a* is a diagram used for the explanation of the relationships among a conventional scroll cam used in prior art traverse motions, the velocity of a strand guide and the shape of a package being formed.

FIG. 8a is the diagram showing the relationships among a conventional scroll cam of a prior art traverse motion, the velocity of the strand guide and the shape of a package being formed. The development of the scroll cam with the right- and left-hand grooves having a predetermined lead angle and being connected to each other at the ends is shown at (2). The rotation of the scroll cam produces the reciprocating motion of the strand guide. As shown at (3), the velocity of the strand guide is constant over the stroke except it momentarily becomes zero at both ends of the stroke. The stroke of the strand guide is equal to the axial length of the grooves as shown at (1). The strand 6 axially dragged by the strand guide 22 is wound around the package with a short time lag from leaving from the strand guide 22 so that there exists an axial distance $\Delta W$ between the strand guide 22 and the strand 6 at the point at which the strand meets the surface of the package. As a result, when the strand guide 22 reaches both ends of its stroke, the strand 6 reaches the position spaced apart by $\Delta W$ from the end of the stroke of the strand guide 22 and remains at this position until the strand guide 22 in the return stroke strats to drag again the strand in the axially opposite direction. As a result, during this time interval, the strand 6 is being wound at the same position without being traversed so that as shown at (1) the diameters at the ends of the package become greater than that between them. This phenomenon is caused inevitably by the delay in response in the sense that the strand 6 lags behind the notch of the strand guide 22. The higher the traversing velocity is the longer the delay in response will be and thus the more this phenomenon will become pronounced. In the production of glass fiber packages for F.R.P., in order to suppress the causes which degrade the qualities of the finished products; that is, in order to prevent the turns of the strand from being bonded to each other at the point where the traversing movement is reversed and to prevent fuzz, the traversing velocity must be made high so that the traversing angle of the package can be increased. As a result, it cannot be avoided that the ends of the package is further increased in diameter. If the pressure roller is pressed against the surface of the package under a high pressure in order to flatten the surface, the end portions of the package would be broken or only the end portions of the package are compressed strongly so that the strand at these portions would be flattened and consequently the shape or cross section of the strand in the package would become not uniform. As a consequence, the qualities of F.R.P. products would be further degraded. In addition, the increase in the contact pressure of the pressure roller for the purpose of flattening the flange-like ends of the package would cause vibrations of the traverse motion.

Figure 8B:
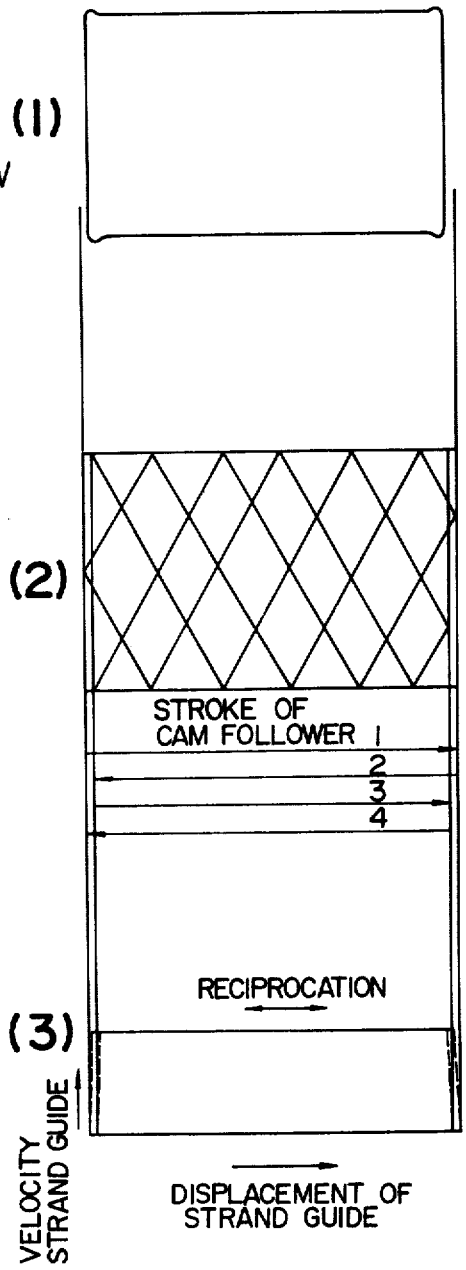
FIG. 8b PRIOR ART
FIG. 8*b* is a diagram similar to FIG. 8*a* except that an improved scroll cam is used in order to suppress the flange-like projections formed at the ends of the package.

FIG. 8b is the diagram showing the relationship among an improved scroll cam devised for suppressing the flange-like distortions at the ends of the package, the velocity of the strand guide and the shape of the package. While with the scroll cam shown in FIG. 8a, the strand guide returns its initial position only after one reciprocating motion, with the scroll cam shown at (a) in FIG. 8b, the strand guide returns to its initial position after two reciprocal motions. In other words, the scroll cam has the cam groove which is in general expressed by $\frac{1}{4}(2n+1)$ winds, where n is any natural number. For instance, the cam groove is that called 2.75, 3.25 or 3.75 winds. The groove of 2.75 winds is shown in FIG. 8b. In addition the cam groove is so arranged as to have a plurality of returning points at each end of stroke. With the 2.75 wind cam groove shown in FIG. 8b, it has two different returning points at each end so that the increase in diameter at both ends of the package can be suppressed to some extent. However, even with the $\frac{1}{4}(2n+1)$ wind cam groove, it is still impossible to completely eliminate the flange-like projections at the ends of the package.

Figure 8C:
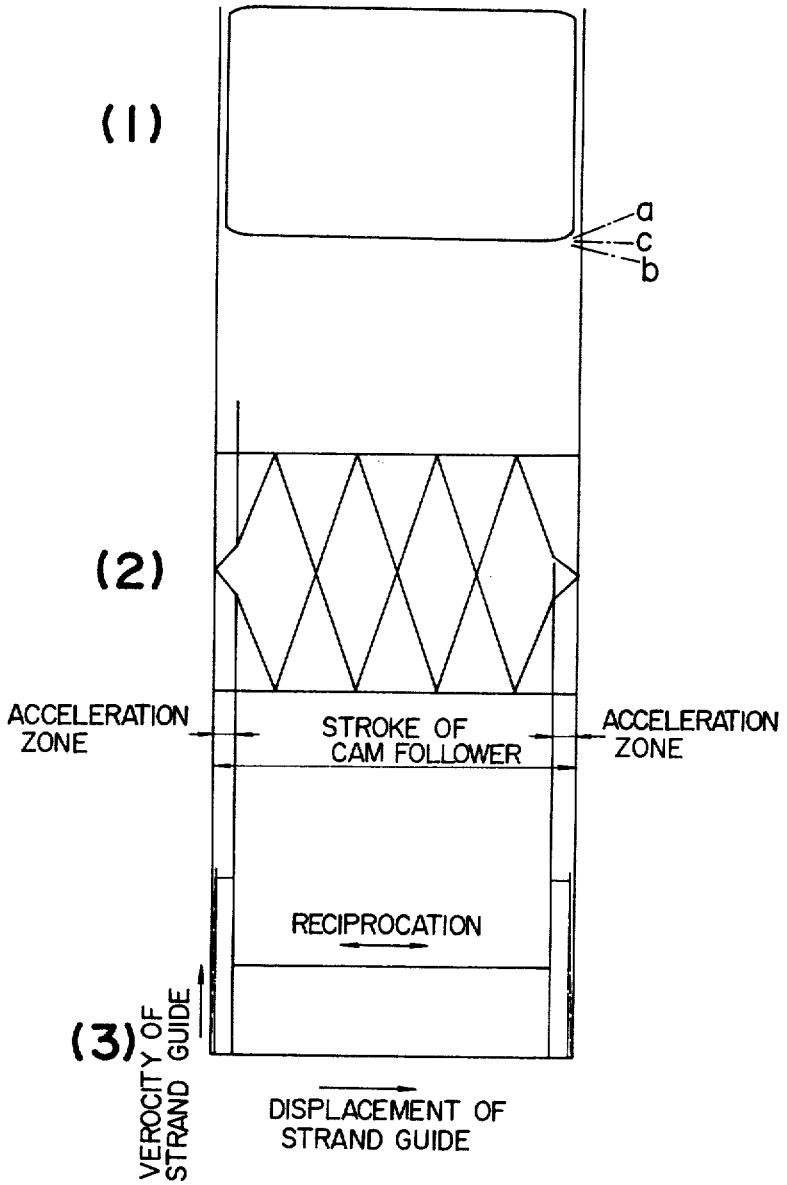
FIG. 8*c* is a diagram also similar to FIG. 8*a* except that a scroll cam in accordance with the present invention is used to obtain packages with square ends.

In view of the above, the present invention provides cam grooves with which the delay in response is permitted whereas the flange-like projections at the ends of the package can be substantially eliminated. As shown at (2) in FIG. 8c, the cam groove in accordance with the present invention is of the $\frac{1}{2}$ n wind type (4 wind type is shown) of returning the strand guide to its initial position after one reciprocating motion and is characterized in that the lead angle is increased only adjacent to the returning points. As a result, as shown at (3), the velocity of the strand guide is increased adjacent to the returning points. If there were no delay in response in the acceleration zones so that the strand could travel in correct alignment with the notch of the strand guide, the number of turns of the strand in each acceleration zone would be reduced as compared with that in the constant velocity zone so that the ends of the package would appear as indicated by a at (1) in FIG. 8c; that is, the ends would be decreased in diameter as compared with the intermediate portion between them. However, in practice, because of the delay in response, the number of turns is increased at both ends as indicated by b. As a result, the decrease in number of turns as shown at a is cancelled by the increase in number of turns as shown at b so that the package with the square ends or the uniform cross section throughout its length can be obtained as indicated at c.

The increase in lead angle must be so determined that the increase in number of turns in the end portions of the package due to the delay in response which is previously estimated can be cancelled. The results of the experiments conducted by the inventor show that it is preferable that the lead angle be increased by 30% adjacent to the returning points or in the acceleration zones.

The practical design factors of one example of the scroll cam in accordance with the present invention are as follows:

cam stroke: 250 mm
winds: 4
acceleration zones: 9.2 mm from both ends: 30° in terms of the angle of rotation of the cam
acceleration rate: 150% (intermediate portion 6.13 mm in length: 30° in terms of the angle of rotation of the cam)
winding speed: 1,000 m/min
turns of the spool per one reciprocating motion of the traverse motion: 3.1

With this cam in which each acceleration zone was defined between the returning point and the center of gravity of each flange-like end portion of the package which would be formed if the acceleration zone would not be provided, the packages with completely square ends could be produced.

According to the present invention, the acceleration zones and the acceleration rate are determined depending upon the winding speed and the traversing speed as desired such that the packages with square ends can be produced. If the winding and traversing speeds are decreased from the predetermined speeds, the response of the strand to the strand guide becomes relatively quick so that the number of turns wound around the ends of the package is decreased as compared with the case of operation at the predetermined speeds and consequently the square ends cannot be attained. Then, however, the ends of the package result in decreasing in diameter as indicated at a in FIG. 8c so that it will not be needed to apply excessive pressure against the package with the pressure roller unlike the case where the flange-like ends are produced and consequently the degradation in quality of packages can be avoided.

The present invention may be summarized as follows. The scroll cam is so designed that the acceleration zones are provided adjacent to the returning points. As a result, the increase in diameter at the ends of the package due to the delay in response of the strand can be avoided and consequently the square ends, which are one of the conditions which the high-quality packages must satisfy, can be attained only with the traverse motion. Therefore the traverse motion in accordance with the present invention is very effective particularly in improving the qualities of packages formed by winding the large-diameter strands consisting of a large numbe of glass fibers drawn through the multiple-nozzle bushing. In addition, when the traverse motion in accordance with the present invention is used in combination with not only the pressure roller which is automatically retracted as the package being formed is increased in diameter so that the pressure roller can press against the surface of the package under a predetermined pressure but also the winding device of the type, as described previously, in which the rotational speed of the winding spool is reduced in inverse proportion to the increase in diameter of the package being formed so that a constant winding speed can be maintained, it becomes possible to produce the packages in which the wound strands have a uniform shape or cross section from the center to the periphery and which have a uniform hardness and therefore extremely high qualities.

What is claimed is:

1. A traverse motion used in combination with a motor and a device for winding a continuous elongate element around a spool, of the type having a scroll cam consisting of a rotatable cylindrical body disposed in parallel with said spool and an endless cam groove consisting of at least one pair of right- and left-hand helical grooves cut in the peripheral surface of said cylindrical body and joined at both ends thereof, a cam follower fitted into said helical grooves of said scroll cam and guided to be reciprocable along a path in parallel with the axis of said scroll cam when the latter is rotated, and guide means connected to said cam follower for traversing said continuous elongate element, in which the lead angle of said helical groove is increased over a predetermined distance adjacent to each end thereof, each end portion of said helical groove with the increased lead angle being in a straight line in the development thereof, said traverse motion further comprising a plate cam rotatable at a predetermined speed by said motor, a rack arranged for linear movement with a cam follower mounted thereon and cooperating with said plate cam, a sector gear being made to mesh with said rack, and a supporting arm operatively connected to said sector gear to rotate in unison with the latter and supporting at its free end said scroll cam, said plate cam having such a cam shape that during winding operation of said spool to form a package therearound, said scroll cam is retracted from the axis of said package with rotation of said plate cam while maintaining a predetermined distance between said scroll cam and the peripheral surface of said package being increased in its diameter.

2. A traverse motion as defined in claim 1, in which said supporting arm further supports at its free end a pressure roller extending parallel with the axis of said scroll cam and adapted to press against the surface of said package being formed and a hydraulic cylinder is operatively connected to said sector gear to force the same in opposite direction to its rotation caused due to the linear movement of said rack.

3. A traverse motion as defined in claim 1 or claim 2, used in combination with a variable-speed motor and in which said spool is driven with said variable-speed motor, further comprising a second plate cam rotatable at the predetermined speed by said first-mentioned plate cam motor, a second rack arranged for linear movement with a cam follower mounted thereon and cooperating with said second cam plate, a pinion being made to mesh with said second rack, and a shift sensor operatively connected to said pinion for producing an output signal of a level corresponding to the angular displacement of said pinion, and control means responsive to said output signal for controlling said variable-speed motor to rotate at speed varied in accordance with the level of said output signal, said second plate cam having such a cam shape that during winding operation of said spool the speed of said variable-speed motor is decreased in inverse proportion to the increase in diameter of the package being formed.

* * * * *